US011624169B2

(12) United States Patent
Kean

(10) Patent No.: US 11,624,169 B2
(45) Date of Patent: Apr. 11, 2023

(54) EXCAVATOR WITH IMPROVED MOVEMENT SENSING

(71) Applicant: Deere & Company, Moline, IL (US)

(72) Inventor: Michael G. Kean, Maquoketa, IA (US)

(73) Assignee: Deere & Company, Moline, IL (US)

( * ) Notice: Subject to any disclaimer, the term of this patent is extended or adjusted under 35 U.S.C. 154(b) by 447 days.

(21) Appl. No.: 16/904,831

(22) Filed: Jun. 18, 2020

(65) Prior Publication Data

US 2021/0395975 A1 Dec. 23, 2021

(51) Int. Cl.

| | |
|---|---|
| ***E02F 9/12*** | (2006.01) |
| ***E02F 3/32*** | (2006.01) |
| ***E02F 3/43*** | (2006.01) |

(52) U.S. Cl.

CPC ..... *E02F 9/123* (2013.01); *E02F 3/32* (2013.01); *E02F 3/435* (2013.01)

(58) Field of Classification Search

CPC ... E02F 3/435; E02F 3/32; E02F 9/123; E02F 9/264

See application file for complete search history.

(56) References Cited

U.S. PATENT DOCUMENTS

| | | | | |
|---|---|---|---|---|
| 10,329,741 | B2 | 6/2019 | Howell et al. | |
| 2017/0107700 | A1 | 4/2017 | Faivre et al. | |
| 2018/0148904 | A1* | 5/2018 | Howell | E02F 9/265 |
| 2018/0298593 | A1 | 10/2018 | Dusha | |
| 2018/0373966 | A1* | 12/2018 | Beschorner | G01C 21/10 |
| 2019/0345697 | A1 | 11/2019 | Ishihara et al. | |

FOREIGN PATENT DOCUMENTS

| | | | |
|---|---|---|---|
| DE | 112014000060 | T5 | 2/2016 |
| DE | 112015006905 | T5 | 7/2018 |
| DE | 102019206515 | A1 | 12/2019 |
| DE | 102018118147 | A1 | 1/2020 |
| JP | 2019027062 | A | 2/2019 |
| WO | 18164078 | A1 | 9/2018 |
| WO | WO2019152494 | A1 | 8/2019 |

OTHER PUBLICATIONS

German Search Report issued in application No. DE102021205025.5 dated Feb. 25, 2022 (05 pages).

* cited by examiner

*Primary Examiner* — Abiy Teka
(74) *Attorney, Agent, or Firm* — Joseph R. Kelly; Kelly, Holt & Christenson, PLLC

(57) ABSTRACT

An excavator includes a rotatable house and a bucket operably coupled to the rotatable house. The excavator also includes one or more swing sensors configured to provide at least one rotation sensor signal indicative of rotation of the rotatable house and one or more controllers coupled to the sensor. The one or more controllers being configured to implement inertia determination logic that determines the inertia of a portion of the excavator and control signal generator logic that generates a control signal to control the excavator, based on the inertia of the portion of the excavator.

20 Claims, 11 Drawing Sheets

EXCAVATOR WITH IMPROVED MOVEMENT SENSING

FIELD OF THE DESCRIPTION

The present description is related to excavators used in heavy construction. More particularly, the present description is related to improved sensing and control in such excavators.

BACKGROUND

Hydraulic excavators are heavy construction equipment generally weighing between 3500 and 200,000 pounds. These excavators have a boom, an arm, a bucket (or attachment), and a cab on a rotating platform that is sometimes called a house. A set of tracks is located under the house and provides movement for the hydraulic excavator.

Hydraulic excavators are used for a wide array of operations ranging from digging holes or trenches, demolition, placing or lifting large objects, and landscaping. Precise excavator operation is very important in order to provide efficient operation and safety. Providing a system and method that increases excavator operational precision without significantly adding to cost would benefit the art of hydraulic excavators.

The discussion above is merely provided for general background information and is not intended to be used as an aid in determining the scope of the claimed subject matter.

SUMMARY

A mobile machine includes a rotatable house and a sensor operably coupled to the rotatable house and configured to provide at least one sensor signal indicative of acceleration. The mobile machine includes one or more controllers coupled to the sensor, the one or more controllers being configured to implement: sensor position determination logic that determines a sensor position of the sensor on the rotatable house based on the sensor signal during a rotation of the rotatable house; and control signal generator logic that generates a control signal to control the mobile machine, based on the sensor position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Precision control or automatic control of an excavator or similar machines, such as cranes or back hoes, rely on a system of sensors. Often, these sensors include inertial measurement units (IMUs) that can detect acceleration, gravity, orientation, angular rotation, et cetera. When the IMU is coupled to the machine at manufacture, the sensors' physical locations on the components of the machine are typically known. However, when the sensors are added at a later time, (e.g., such as aftermarket components or manufacturer upgrade components) the sensors' precise location and/or orientation on the machine is unknown. While the additional sensors may be used without knowing their precise location, being able to determine their location on the machine allows for higher precision control.

When an object is rotated about an axis, the acceleration it experiences is a function of its displacement from the rotational axis. Therefore, the location of a sensor can be determined based on the sensor data collected (e.g., acceleration) during a rotation of the sensor about one or more axes in one or more directions. Additionally, sensors may be mounted on components that are movable in relation to the rotational axis (e.g., a boom is movable in relation to the swing axis of the house). Accordingly, the component may be moved from one pose to another between rotations. With the known geometry of the component and the sensed accelerations in the different poses, the sensor location ambiguity can be reduced or eliminated.

Figure 1:
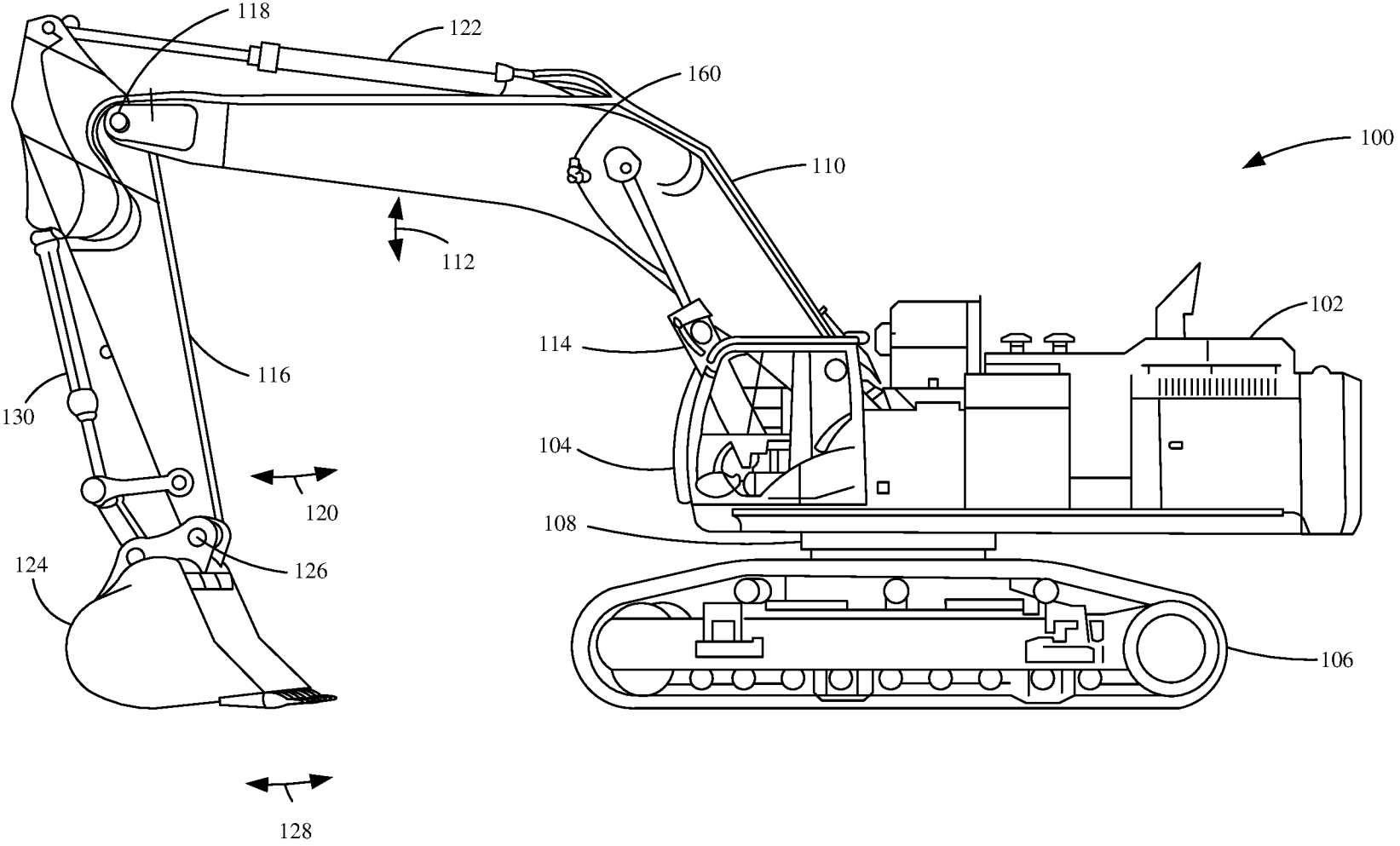
FIG. 1 is a diagrammatic view showing an example mobile machine.

FIG. 1 is a diagrammatic view showing an example machine 100 that is an excavator. Excavator or machine 100 includes a house 102 having an operator cab 104 rotatably disposed above tracked portion 106. House 102 may rotate 360 degrees about tracked portion 106 via rotatable coupling 108. A boom 110 extends from house 102 and can be raised or lowered in the direction indicated by arrow 112 based upon actuation of hydraulic cylinder(s) 114. A stick or arm 116 is pivotably connected to boom 110 via linkage pin 118 and is movable in the direction of arrows 120 based upon actuation of hydraulic cylinder 122. Bucket or attachment 124 is pivotably coupled to arm 116 at linkage pin 126 and is rotatable in the direction of arrows 128 about linkage pin 126 based on actuation of hydraulic cylinder 130.

Figure 2:
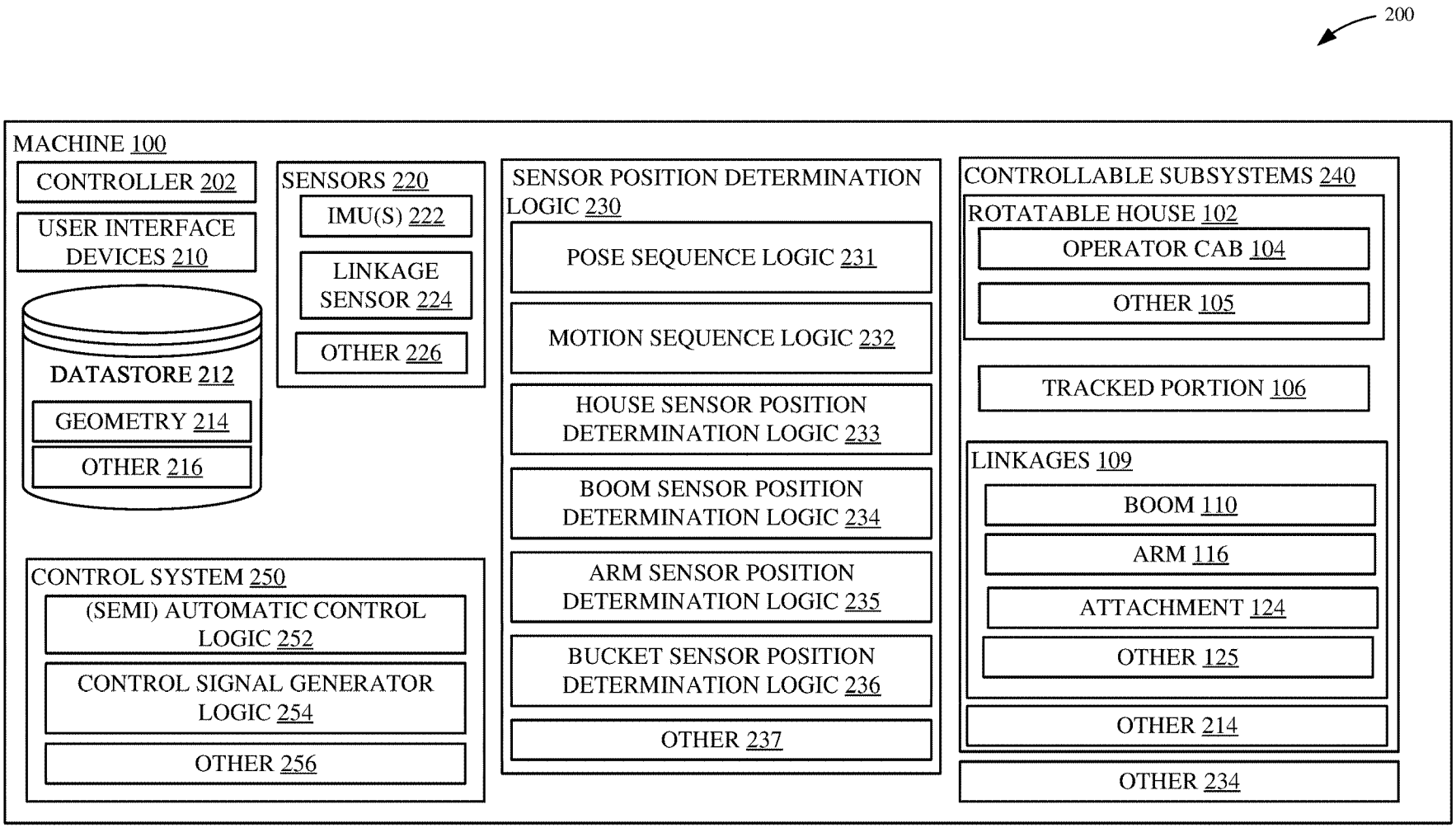
FIG. 2 is a block diagram showing an example mobile machine.

FIG. 2 is a diagrammatic view showing an example machine 100. Machine 100 includes controller 202, user interface devices 210, Datastore 212, sensors 220, sensor position determination logic 230, controllable subsystems 240, control system 250 and can include other items as well, as indicated by block 280. Illustratively, the components are part of machine 100, however, some of the shown blocks may be located remotely from machine 100 (e.g., on a remote server, on a different machine, etc.).

Controller 202 is configured to receive one or more inputs, perform a sequence of programmatic steps to generate one or more suitable machine outputs for controlling the operation of machine 100 (e.g., implementing the various logic components). Controller 202 may include one or more microprocessors, or even one or more suitable general computing environments as described below in greater detail. Controller 202 is coupled to user interface devices 210 in order to receive machine control inputs from an operator within cab. Examples of operator inputs include joystick movements, pedal movements, machine control settings, touch screen inputs, etc. Additionally, user interface devices 210 also include one or more operator displays in order to provide information regarding excavator operation to the operator.

Data store 212 stores various information for the operation of machine 100. Illustratively, geometry 214 that corresponds the geometry of various components of machine 100 (e.g., controllable subsystems 240) are stored in data store 212. For example, the dimensions and shape of boom 110 are stored in geometry 214. Such information may include the length, width, height, bends, radii of corners, size and location of the linkage pins, mass, center of mass, etc. Geometry 214 can also include three-dimensional models of the components, including subcomponents and mass calculations. Of course, data store 212 can include many other items as well as indicated by block 216.

Sensors 220 include inertial measurement units (IMU) 222, linkage sensors 224 and can include a variety of other sensors as well, as indicated by block 226. IMU sensors 222 can be disposed on machine 100 at a variety of different places. For instance, IMU sensors 222 can be placed on the rotatable house 102, boom 110, arm 116 and attachment 124. IMU sensors 222 are able to sense acceleration, orientation, rotation, etc. They are displaced on these and other components of machine 100 for precise control of machine 100.

Sensors 220 also include linkage sensors 224 which can include strain gauges, linear displacement transducers, potentiometers, et cetera. Linkage sensors 224 can sense the force applied on the controllable subsystems 240 and/or the orientation of the controllable subsystems via the displacement of its actuator. For instance, boom 110 is often actuated by a hydraulic cylinder and the displacement of the piston in the cylinder will correlate to a location of boom 110 relative to rotatable house 102. In another example, a potentiometer can be located proximate a linkage pin between boom 110 and arm 116, this potentiometer will output a signal indicative of the angle between boom 110 and arm 116.

Sensor position determination logic 230 determines the position of the various IMU sensors 222 (or other sensors) on machine 100. Sensor position determination logic 230 includes pose sequence logic 231, motion sequence logic 232, house sensor position determination logic 233, boom sensor position determination logic 234, arm sensor position determination logic 235, attachment sensor position determination logic 236 and can include other components as well as indicated by block 237. Pose sequence logic 231 generates or selects a sequence of poses for machine 100 to actuate to during a sensor position determination process. For example, to determine the position of a sensor on machine 100 it may be beneficial to change the pose of machine 100 and accelerate (e.g. rotate house 102) in various poses. This is because as the pose changes, the sensor will be displaced (predictably) at a different relative location to the rotational axis of rotatable house 102.

Motion sequence logic 232 generates or selects a sequence of motions for machine 100 to actuate through during a sensor position determination process. For example, to determine a position of a sensor on machine 100, creating motion allows for the detection of acceleration, especially angular acceleration and velocity. Since angular acceleration/velocity share a relationship with the physical displacement from the rotation axis, a known rotational acceleration/velocity can be used to determine the physical displacement from the rotation axis. This and the known geometry from geometry 214 and linkage locations to one another can provide the locations of the sensors on their respective controllable subsystems 240. Motions generated or selected by motion sequence logic 232 also can include periods of rest, such that the orientation of IMU sensors 222 can be determined. Also, the periods of rest allow for a control value or angle of an IMU sensor 222.

House sensor position determination logic 233 receives sensor signals from IMU sensor 222 that is located on rotatable house 102. As the rotatable house 102 rotates through a given series of motions and rests the attached IMU sensor 222 will generate various readings. House sensor position determination logic 233 receives these readings and determines a position of the IMU sensor 222 on rotatable house 102 based on those readings. Of course, house sensor position determination logic 233 can determine the position of an IMU sensor 222 located on rotatable house 102 in other ways as well. For example, house sensor position determination logic 233 can generate an interface that allows a user to enter user input and house sensor position determination logic 233 determines the sensor location based on the user input.

Boom sensor position determination logic 234 receives sensor signals from IMU sensor 222 that is located on boom 110. As the rotatable house 102 rotates through a given series of motions and rests, boom 110 also rotates and pauses and the attached IMU sensor 222 will generate various readings. Boom sensor position determination logic 234 receives these readings and determines a position of IMU sensor 222 on boom 110 based on the sensor readings. Of course, boom sensor position determination logic 234 can determine the position of an IMU sensor 222 located on boom 110 in other ways as well. For instance, an actuator of boom 110 may actuate and the readings received from IMU 222 during this actuation may be used to calculate the position of sensor 222. In another example, boom sensor position determination logic 234 can generate an interface that allows a user to enter user input and boom sensor position determination logic 234 determines the sensor location based on the user input.

Arm sensor position determination logic 235 receives the sensor signals from one or more IMU sensors 222 that are located on arm 116. As the rotatable house 102 rotates through a given series of motions and rests, arm 116 also rotates and pauses and the attached IMU sensors 222 will generate various readings. Arm sensor position determination logic 235 receives these readings and determines a position of IMU sensor 222 on arm 116. Of course, arm sensor position determination logic 235 can determine the position of an IMU sensor 222 located on arm 116 in other ways as well. For instance, an actuator of arm 116 may actuate and the readings received from IMU 222 during this actuation may be used to calculate the position of sensor 222. In another example, arm sensor position determination logic 235 can generate an interface that allows a user to enter user input and arm sensor position determination logic 235 determines the sensor location based on the user input.

Attachment sensor position determination logic 236 receives the sensor signals from one or more IMU sensors 222 that are located on attachment 124. As the rotatable house 102 rotates through a given series of motions and pauses, attachment 124 also rotates and pauses and the attached IMU sensors 222 will generate various readings.

Attachment sensor position determination logic 236 receives these readings and determines a position of IMU sensor 222 on attachment 124. Of course, attachment sensor position determination logic 236 can determine the position of an IMU sensor 222 located on attachment 124 in other ways as well. For instance, an actuator of attachment 124 may actuate and the readings received from IMU 222 during this actuation may be used to calculate the position of sensor 222. In another example, attachment sensor position determination logic 236 can generate an interface that allows a user to enter user input and attachment sensor position determination logic 236 determines the sensor location based on the user input.

Control system 250 controls the operations of machine 100. Control system 250 includes (semi)automatic control logic 252, control signal generator logic 254 and can include other items as well, as indicated by block 256. (Semi) automatic control logic 252 allows for fully automatic or partially automatic control by an operator of machine 100. For instance, semi-automatic control would include smart grade operations that would allow an attachment 124, that is a bucket, to grade or dig a flat bottom trench, despite the standard displacement of linkages 109 during actuation being circular (e.g., due to rotation about linkage pins). Fully automatic control can include full-automatic control by the system, such as digging a trench without user intervention.

Figure 3:
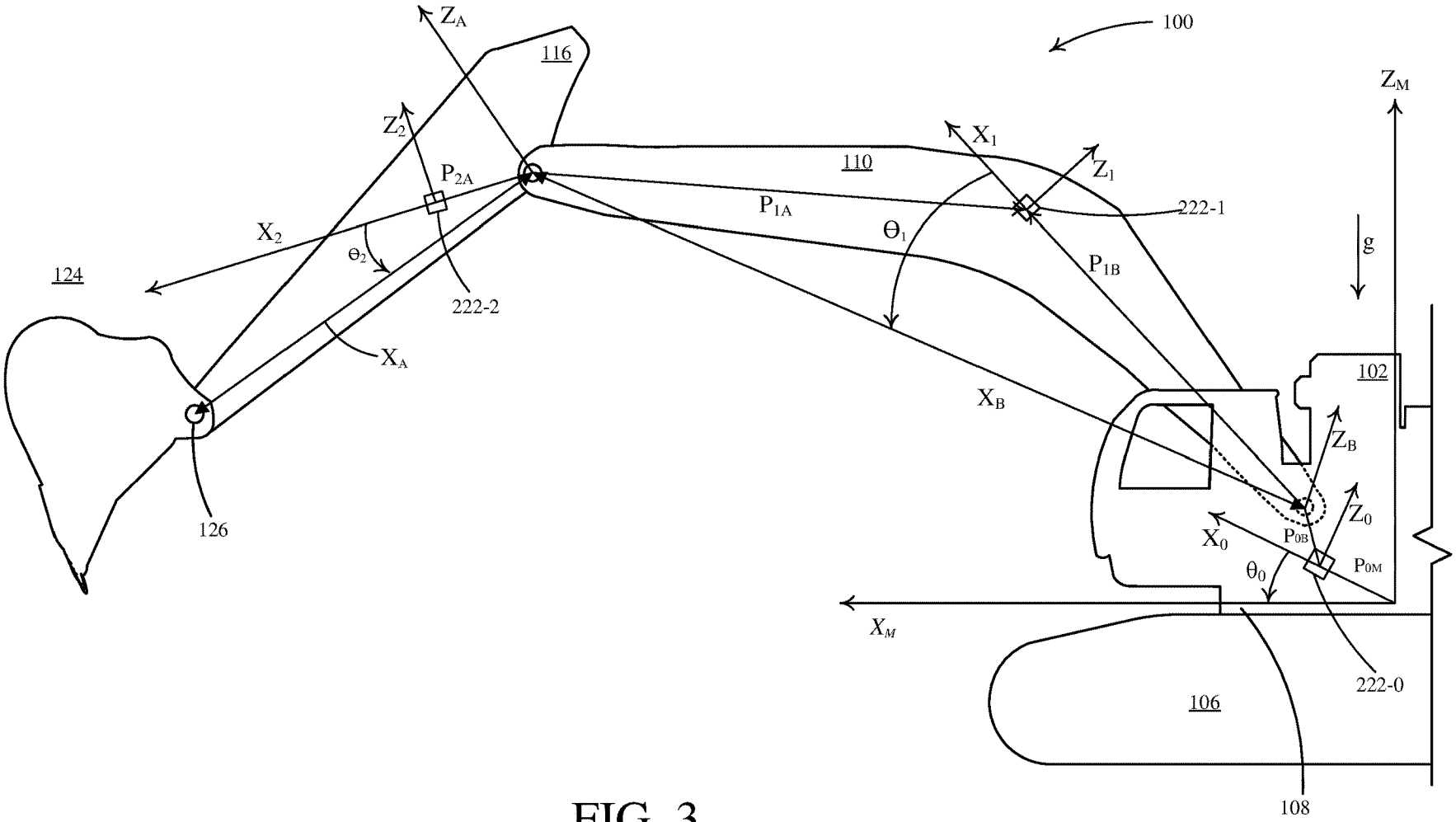
FIG. 3 is a diagrammatic view showing an example mobile machine.

FIG. 3 is a diagrammatic view of an example excavator. The illustrated dimensions can be calculated using one or more of the methods described herein. A machine Z axis ($Z_M$) is defined by the rotational axis of rotatable house 102. Ideally, $Z_M$ is parallel to gravity, as represented by arrow g. However, if machine 100 is located on uneven ground arrow g and $Z_M$ will not be parallel and the discrepancy can be accounted for. A machine X axis ($X_M$) is perpendicular to $Z_M$ and extends in a positive direction towards boom 110. As shown, there is a sensor 222-0 on rotatable house 102. Sensor 222-0 is located $P_{0M}$ away from the $Z_M$, $X_M$ origin at an angle of $\theta_0$. Sensor 222-0 is also located $P_{0B}$ away from boom 110 linkage pin.

Boom 110 has a boom X axis ($X_B$) defined by a line connecting the boom/house linkage pin to the boom/arm linkage pin. A boom Z axis ($Z_B$) is perpendicular to $X_B$ and extends upward from the boom/house linkage pin. As shown, there is a sensor 222-1 on boom 110. Sensor 222-1 is located $P_{1B}$ away from the $X_B$, $X_Z$ origin at an angle of $\theta_1$. Sensor 222-1 is also located $P_{1A}$ away from boom 110/arm 116 linkage pin.

Arm 116 has an arm X-axis ($X_A$) defined by a line connecting the arm/boom linkage pin to the arm/attachment linkage pin. An arm Z-axis is perpendicular to $X_A$ and extends upward from the boom/arm linkage pin. As shown, there is a sensor 222-2 on arm 116. Sensor 222-2 is located $P_{2A}$ away from the $X_A$, $X_A$ origin at an angle of $\theta_2$.

The positions of sensors 222-0, 222-1, 222-2 can be defined globally (e.g., on $X_M$ and $Z_M$), locally (e.g., on $X_B$, $Z_B$ or $X_A$, $Z_A$), or relative to some other point on machine 100. Of course, any position defined on one of these spectrums can be converted to another. For instance, as shown the local X-axis passes through the pin joint, however, in other examples the X-axis could be defined elsewhere.

Figure 4:
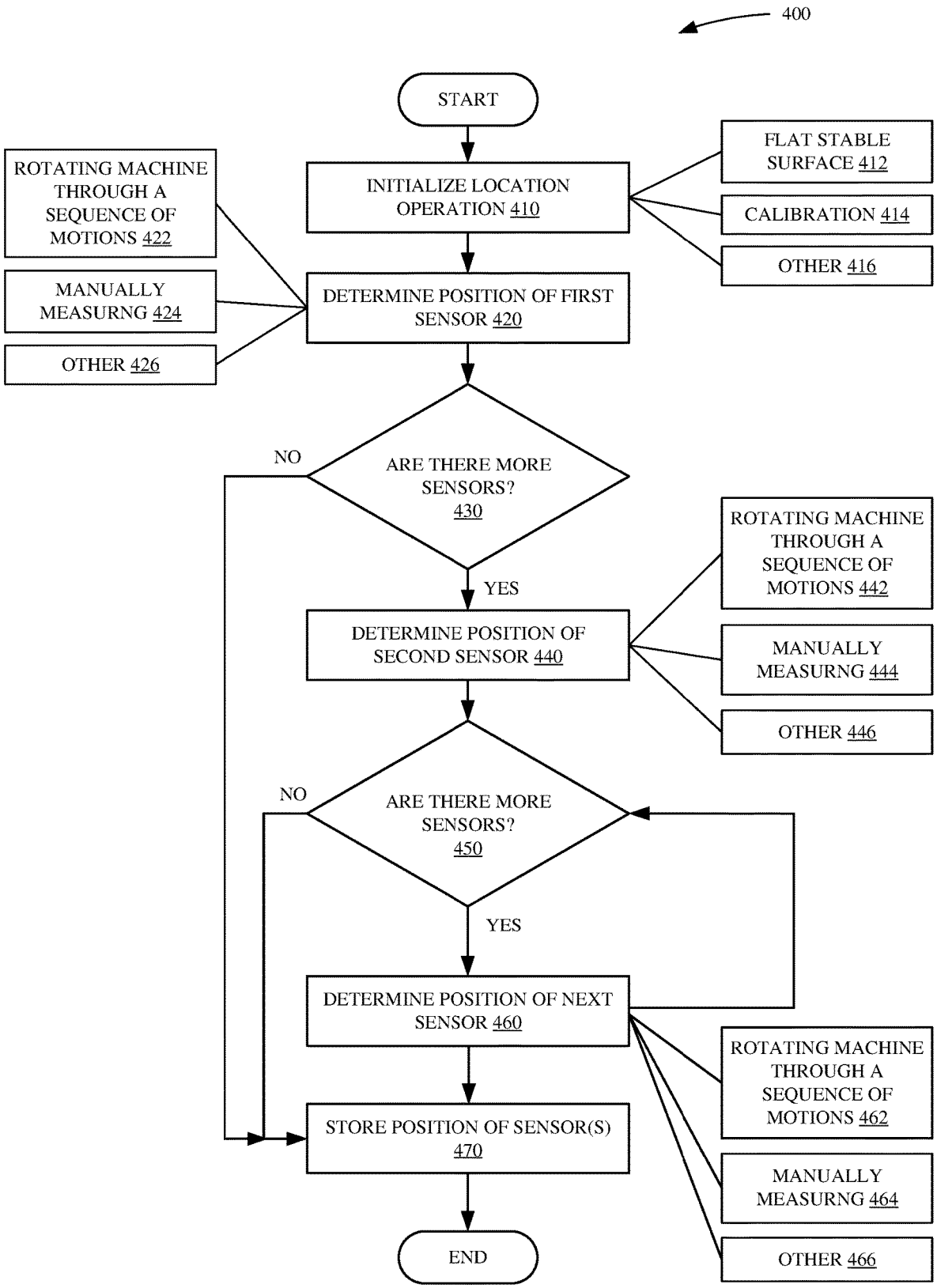
FIG. 4 is a flow diagram showing an example method of determining sensor locations.

FIG. 4 is a flow diagram showing an example operation 400 of providing determining a position of various sensors on a mobile machine. Operation 400 begins at block 410 where the sensor location operation 400 initializes. As indicated by block 412, initialization can include moving machine 100 to a flat stable surface. The surface will allow for setting a baseline for sensors 222 (e.g., for calibration). As indicated by block 414, initialization can include calibrating the various sensors 220. Calibration can account for unlevel terrain that may affect sensor readings (e.g., acceleration and deceleration as a sensor is rotated about an axis that is tilted from the gravitational axis). Calibration can also account for other factors that may skew sensor signals and calculations based off the sensor signals. As indicated by block 416, initialization can include other processes as well. For example, moving machine 100 to an open area where it can extend all its controllable subsystems 240 without colliding with another object.

Operation 400 proceeds at block 420 where the position of the first sensor (e.g., sensor 222 on rotatable house 102) is determined. As indicated by block 422, the position may be determined based on, amongst other things, the sensor signal output of sensor 222 as machine 100 is rotated through a series of motions. As indicated by block 424, the position may be determined based on manually measuring the location of sensor 222 on rotatable house 102. As indicated by block 426, the position may be determined in other ways as well.

Operation 400 proceeds at block 430 where it is determined if there are more sensors to be located. If not, then operation 400 proceeds at block 470 which will be described in greater detail below. If so then operation 400 proceeds at block 440.

At block 440, the position of the second sensor (e.g., sensor 222 on boom 110) is determined. As indicated by block 442, the position may be determined based on the sensor signal output of sensor 222 on boom 110 as machine 100 is rotated through a series of motions. As indicated by block 444, the position may be determined based on manually measuring the location of sensor 222 on boom 110. As indicated by block 446, the position may be determined in other ways as well. For instance, by analyzing an image taken of the sensor on machine 100, the image can be analyzed for machine parts and the sensor. Then the distance between these parts in the image can be used to determine the sensor's physical location.

Operation 400 proceeds at block 450 where it is determined if there are more sensors to be located. If not, then operation 400 proceeds at block 470 where the positions of the sensors are stored in, for example datastore 212. If so, then operation 400 proceeds at block 460 where the position of the next sensor is determined. As indicated by block 462, the position may be determined based on the sensor signal output of sensor 222 as machine is rotated through a series of motions (e.g., rotating house 102, raising boom 110, lowering boom 110, extending arm 116, retracting arm 116, etc.). As indicated by block 464, the position may be determined based on manually measuring location of sensor 222. As indicated by block 466, the position may be determined in other ways as well.

Figure 5A:
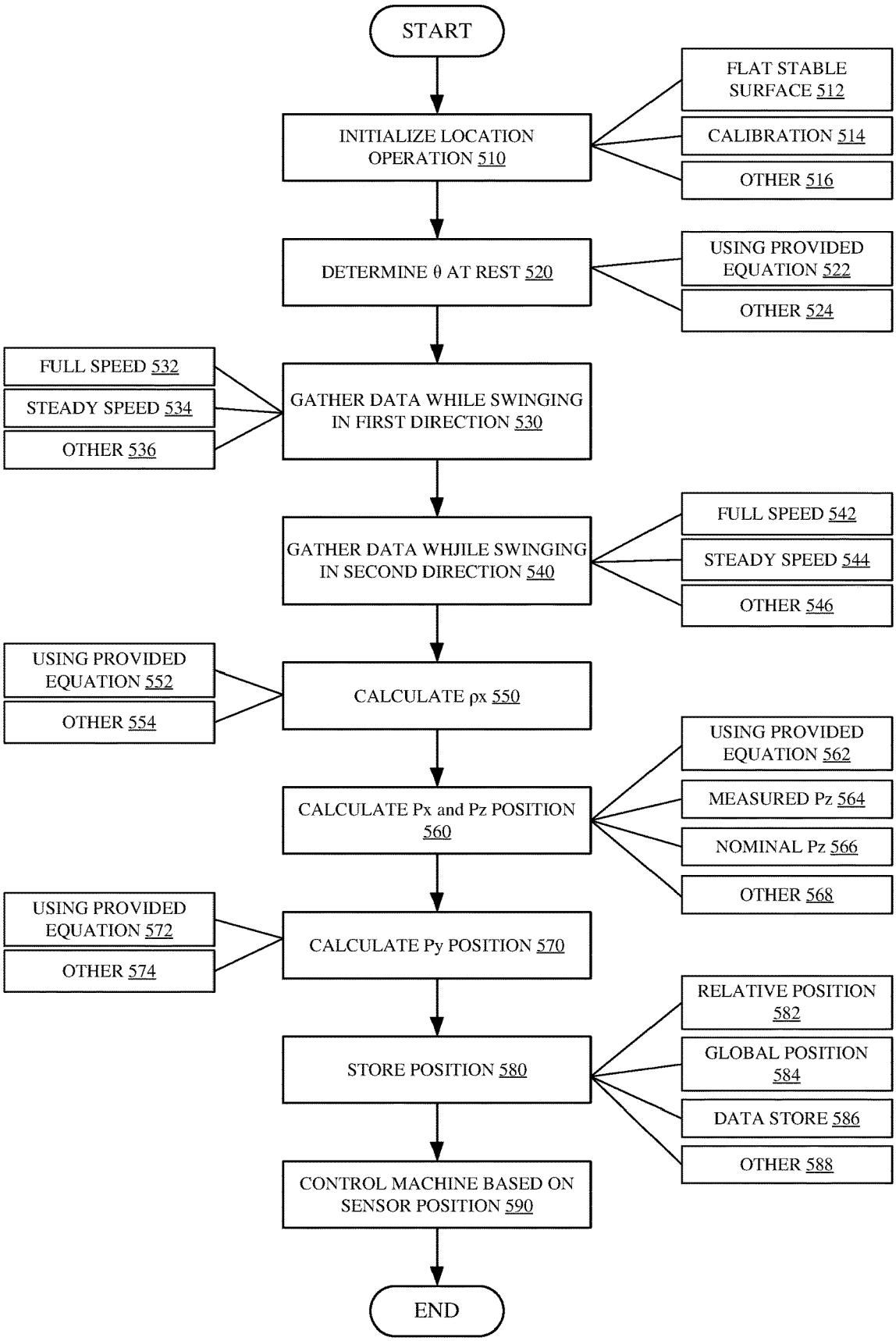
FIG. 5A is a flow diagram showing an example method of determining a house sensor location.

FIG. 5A is a flow diagram showing an example operation 500 of determining a position of a sensor on rotatable house 102 on machine 100. FIG. 5A will reference aspects in FIG. 3 or FIG. 5B for ease of explanation. FIG. 5A may also reference the following 11 equations. Equations 1-3 are used for calculations at rest (e.g., FIG. 5A) and equations 4-11 are used for calculations during a steady state swing (or near steady state swing). For the sake of clarity and repeatability below, numbered subscripts have been removed from the following equations.

$$\theta = \operatorname{atan}\left(\frac{-A_x}{A_z}\right) \quad \text{Eq. 1}$$

-continued $$A_x = -g\sin\theta \quad \text{Eq. 2}$$

$$A_z = g\cos\theta \quad \text{Eq. 3}$$

$$\overline{p} * \overline{\omega} * \overline{\omega} = \begin{bmatrix} -\omega^2 p\overline{x} \\ -\omega^2 p_{\overline{Y}} \\ 0 \end{bmatrix} \quad \text{Eq. 4}$$

$$A_x = -g\sin\theta - \omega^2 p\overline{x}\cos\theta \quad \text{Eq. 5}$$

$$A_y = -\omega^2 p\overline{Y} \quad \text{Eq. 6}$$

$$A_z = g\cos\theta - \omega^2 p\overline{x}\sin\theta \quad \text{Eq. 7}$$

$$p\overline{x} = -\left(\frac{g\sin\theta + A_x}{\omega^2\cos\theta}\right) \quad \text{Eq. 8}$$

$$p\overline{x} = -\left(\frac{g\cos\theta + A_z}{\omega^2\sin\theta}\right) \quad \text{Eq. 9}$$

$$p_x = p\overline{x}\cos\theta - p_Z\sin\theta \quad \text{Eq. 10}$$

$$p_z = p\overline{x}\sin\theta + p_Z\cos\theta \quad \text{Eq. 11}$$

Operation 500 begins at block 510 where sensor location determination operation 500 initializes. As indicated by block 512, initialization can include moving machine 100 to a flat stable surface. As indicated by block 514, initialization can include calibrating one or more sensors 220 on machine 100. Of course, initialization can include a variety of other things, as indicated by block 516. For instance, initialization can include loading machine geometry or locations of other sensors or components of machine 100.

Figure 5B:
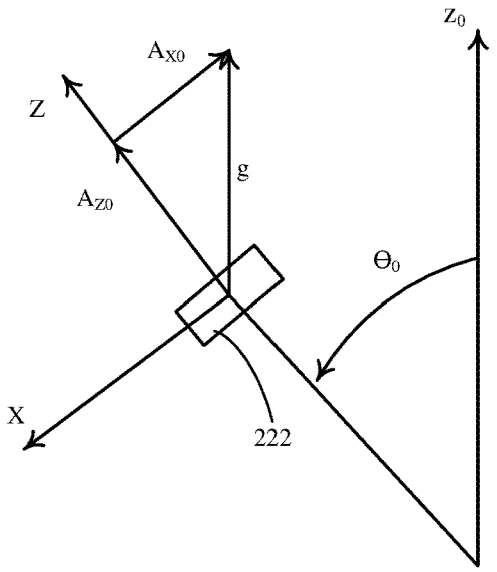
FIGS. 5B-5C are diagrammatic views showing an example mobile machine.

Operation 500 proceeds at block 520 where the angle of sensor 222 is determined at rest. For example, angle $\theta_0$ in FIG. 5B is determined at rest. Angle $\theta_0$ can be determined as shown in Equation 1 above.

Operation 500 proceeds at block 530 where rotatable house 102 is swung about a Z-axis in one direction (e.g., counter clockwise) and during this rotation, sensor data is gathered. For example, sensors 220 (e.g., IMU 222) sense characteristics of the motion (e.g., acceleration, force, etc.) and the sensed data is stored. As indicated by block 532, rotatable house 102 is swung at full speed. As indicated by block 534, rotatable house 102 is swung at a steady state that could be less than full speed. As indicated block 536, rotatable house 102 is swung at a different speed or state.

Operation 500 proceeds at block 540 where rotatable house 102 is swung about the Z-axis in a second direction that is opposite the first direction (e.g., clockwise) and during this rotation, sensor data is gathered. For example, (e.g., IMU 222) sense characteristics of the motion and the sensed data is stored. As indicated by block 542, rotatable house is swung at full speed. As indicated by block 544, rotatable house 102 is swung at a steady state that could be less than full speed. As indicated by block 546, rotatable house 102 is swung at a different speed or state.

Figure 5C:
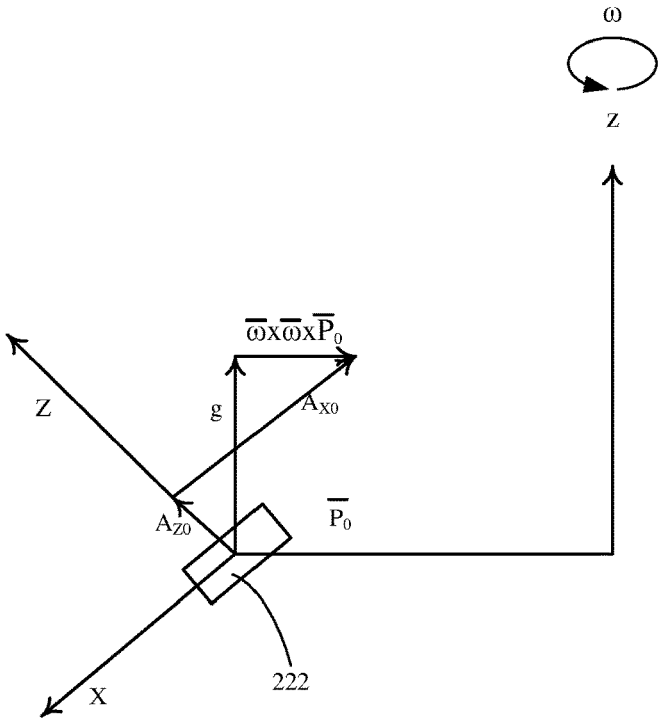

Operation 500 proceeds at block 550 where the distance $P_X$ is calculated. Global $P_{0MX}$ can be calculated in a few different ways. For example, global $P_X$ can be calculated using equations 8 and 9 above, with respect to FIG. 5C. Or global $P_X$ can be calculated with a best fit of data collected in block 530 and 540 using 0 determined in block 520. Equations 4-11 are applicable during a steady state rotation where co is the angular velocity and the other variables correspond to reference numerals in FIG. 3.

Operation 500 proceeds at block 560 where $P_X$ and $P_Z$ are calculated. $P_X$ and $P_Z$ can be calculated using equations 10 and 11 shown below. The global $P_X$ calculated in block 550 is used to solve for $P_X$ and $P_Z$. As indicated by block 562, a measured $P_Z$ can be used to solve for $P_X$ and $P_Z$. As indicated by block 564, a nominal $P_Z$ can be used to solve for $P_X$ and $P_Z$. Of course, $P_X$ and $P_Z$ can be determined in other ways as well as indicated by block 566.

Operation 500 proceeds at block 570 where $P_Y$ is determined. $P_Y$ can be determined using equation 6 above and the data collected in blocks 530 and 540. Of course, $P_Y$ can be determined in other ways as well as indicated by block 564.

Operation 500 proceeds at block 580 where the position is stored for later use. As indicated by block 582 the relative positions of the sensors can be stored. For example, the position of the sensor relative to a component of machine 100 (e.g., a linkage pin, the boom, house, arm, etc.) As indicated by block 584, the global position of the sensors can be stored. For example, the position of the sensor relative to the swing axis of machine 100 or a position of the sensor relative to the ground. As indicated by block 586, the position of the sensor may be stored in data store 212 on machine 100. Of course, the position of the sensor may be stored in some other format at a different location as well, as indicated by block 588.

Operation 500 proceeds at block 590 where machine 100 is controlled based on the position of one or more sensor(s) 222.

Figure 6A:
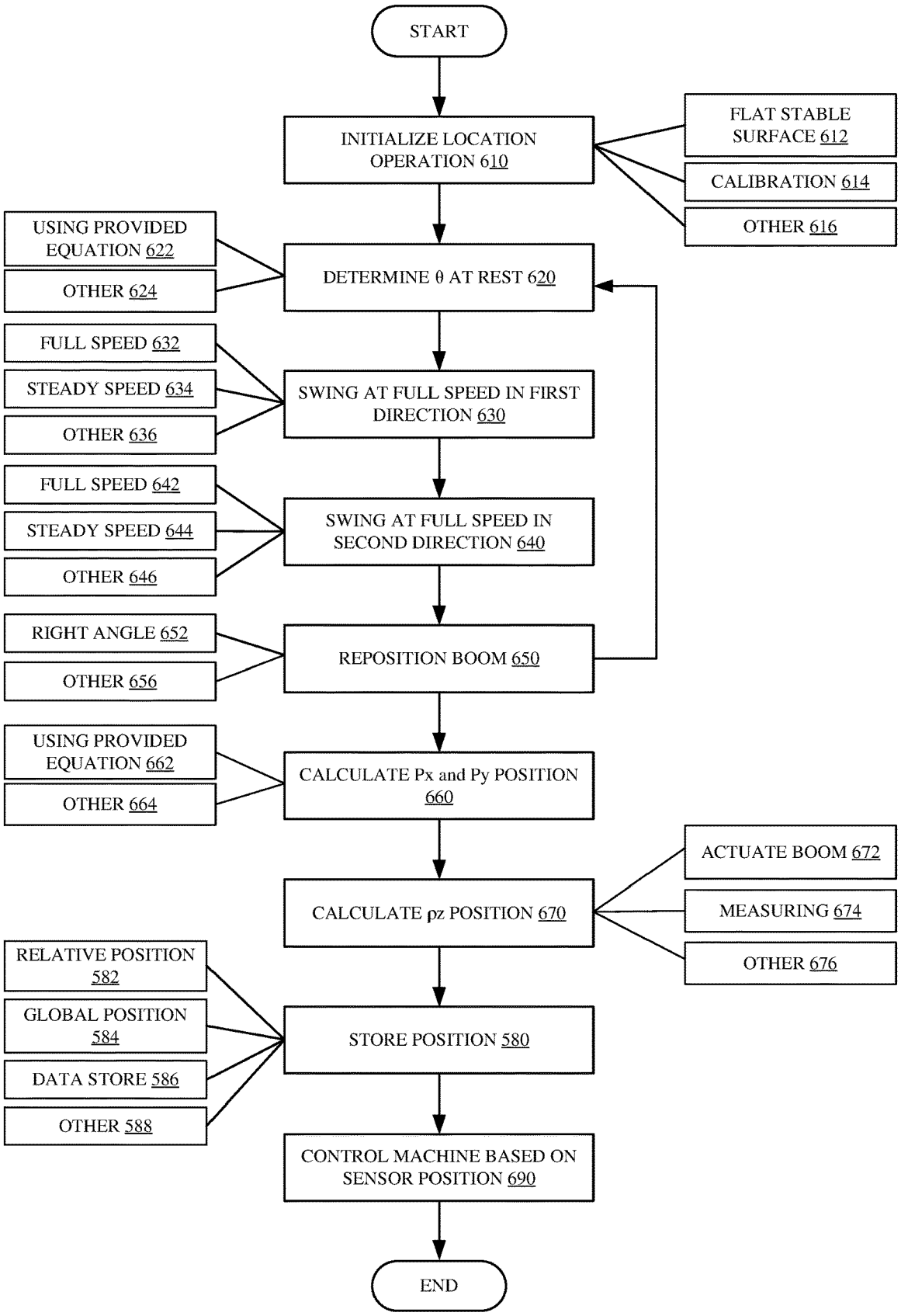
FIG. 6A is a flow diagram showing an example method of determining a boom sensor location.
Figure 6B:
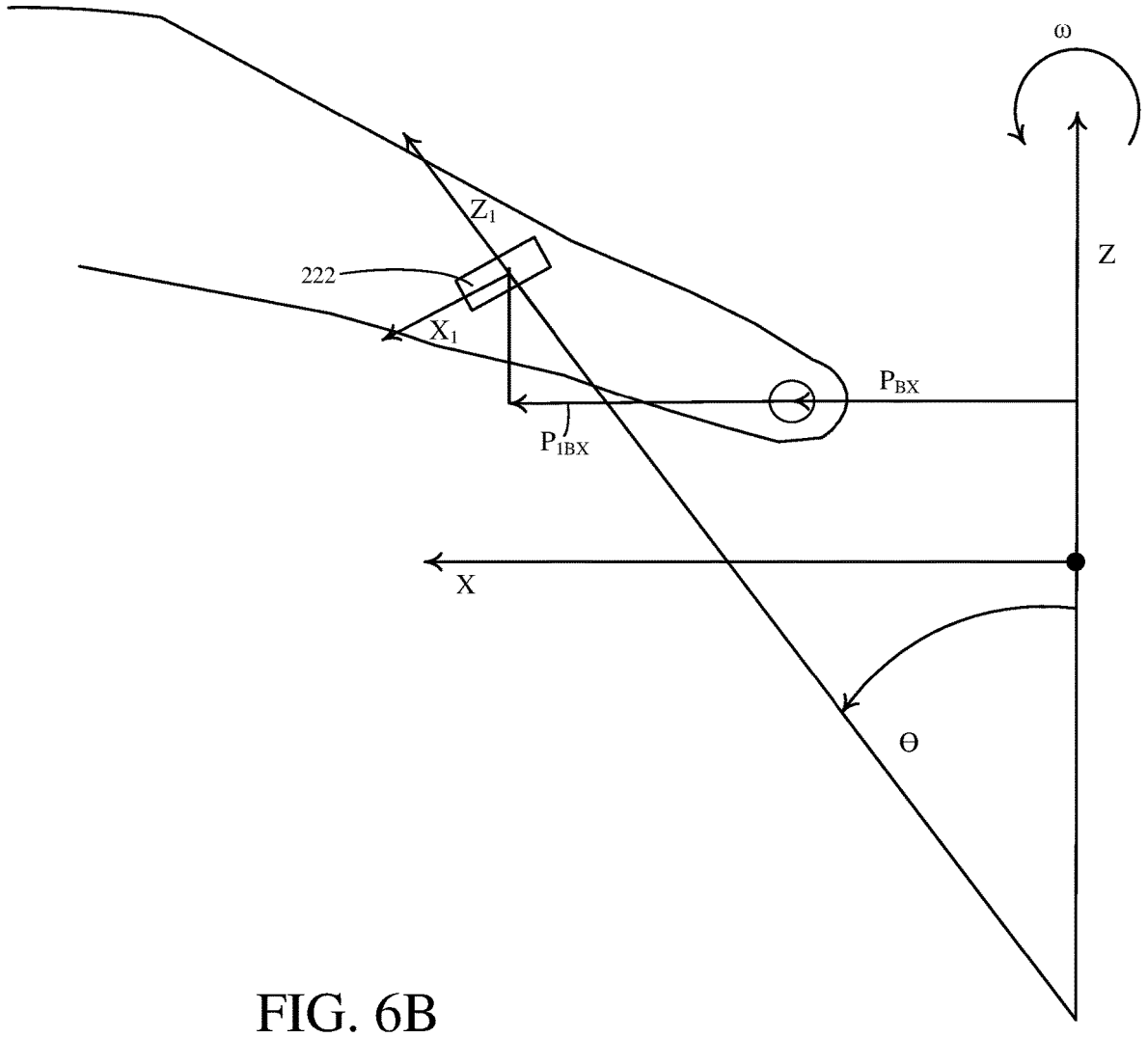
FIG. 6B is a diagrammatic view showing an example mobile machine.

FIG. 6A is a flow diagram showing an example operation of determining a boom sensor position. FIG. 6A will reference aspects of FIGS. 3 and 6B for ease of explanation. FIG. 6A may also reference the following 8 equations that apply during a steady state rotation. θ in equation 11 corresponds to θ in FIG. 6B.

$$A_{\overline{X}\overline{Y}Z} = \begin{bmatrix} \cos\theta & 0 & \sin\theta \\ 0 & 1 & 0 \\ -\sin\theta & 0 & \cos\theta \end{bmatrix} A_{xyz} \; A_{xyz} = \begin{bmatrix} \cos\theta & 0 & -\sin\theta \\ 0 & 1 & 0 \\ \sin\theta & 0 & \cos\theta \end{bmatrix} A_{\overline{X}\overline{Y}Z} \quad \text{Eq. 11}$$

$$A_{\overline{X}} = \omega^2(\rho_{B\overline{X}}) + (\rho_{1B\overline{X}}) = -\omega^2(pbx + \cos\theta_{\rho_x} + \sin\theta_{\rho Z}) \quad \text{Eq. 12}$$

$$A_{\overline{Y}} = -\omega^2 p_{\overline{Y}} = -\omega^2 py \quad \text{Eq. 13}$$

$$A_z = g \quad \text{Eq. 14}$$

$$A_{\overline{X}Pos1} + \omega^2 pBX = [\cos\theta_1 \;\; \sin\theta_1]\begin{bmatrix} p_x \\ p_z \end{bmatrix} \quad \text{Eq. 15}$$

$$A_{\overline{X}Pos2} + \omega^2 pBX = [\cos\theta_2 \;\; \sin\theta_2]\begin{bmatrix} p_x \\ p_z \end{bmatrix} \quad \text{Eq. 16}$$

$$A_{\overline{x}p\overline{os}1} = [\cos\theta_1 \;\; \sin\theta_1]\begin{bmatrix} A_x \\ A_z \end{bmatrix} \quad \text{Eq. 17}$$

$$A_{\overline{X}Pos2} = [\cos\theta_2 \;\; \sin\theta_2]\begin{bmatrix} A_x \\ A_z \end{bmatrix} \quad \text{Eq. 18}$$

Operation 600 begins at block 610 where operation 600 is initialized. As indicated by block 612, initialization can include moving machine 100 to a flat stable surface. As indicated by block 614, initialization can include calibrating sensors 220 on machine 100. Of course, initialization can include a variety of other things as indicated by block 616. For instance, initialization can include loading machine geometry or locations of other sensors or components of machine 100.

Operation 600 proceeds at block 620 where $\theta_1$ is determined at rest. $\theta_1$ can be determined using the above-mentioned equation 1, as indicated by block 622. $\theta_1$ can be determined in other ways as well, as indicated by block 624.

Operation 600 proceeds at block 630 where rotatable house 102 is swung about a Z axis in one direction (e.g., counter clockwise) and during this rotation, sensor data is gathered. For example, sensors 220 (e.g., IMU 222) sense characteristics of the motion and the sensed data is stored. As indicated by block 632, rotatable house 102 is swung at full speed. As indicated by block 634, rotatable house 102 is swung at a steady state that could be less than full speed. As indicated block 636, rotatable house 102 is swung at a different speed or state.

Operation 600 proceeds at block 640 where rotatable house 102 is swung about the Z axis in a second direction that is opposite the first direction (e.g., clockwise) and during this rotation, sensor data is gathered. For example, (e.g., IMU 222) sense characteristics of the motion and the sensed data is stored. As indicated by block 642, rotatable house could be swung at full speed. As indicated by block 644, in addition or in the alternative, rotatable house 102 is swung at a steady state that could be less than full speed. As indicated by block 646, in addition or in the alternative, rotatable house 102 is swung at a different speed or state.

Operation 600 proceeds at block 650 where boom 110 is repositioned. After boom 110 is repositioned, operation 600 repeats blocks 620-640 with boom 110 in the new position. As indicated by block 662, the new position can be a 90-degree rotation of boom 110. The new position can include a different rotation or pose as indicated by block 656.

Operation 600 proceeds at block 660 where $P_X$ and $P_Y$ are determined. As indicated by block 662, $P_X$ and $P_Y$ can be determined using equations 15-18 above. For example, a best fit of the sensor data for the first position could be calculated with equation 15 and equation 16 for the second position where equations 17 and 18 are assumed. Note that $\theta_1$ in equation 15 represents the angle of boom 110 in the first position and $\theta_2$ in equation 16 represents the angle of boom 110 in the second position.

Operation 600 proceeds at block 670 where $P_Z$ is calculated. As indicated by block 672, boom 110 can be actuated and based on the sensor signal during actuation, $P_Z$ can be calculated. As indicated by block 674, $P_Z$ can be determined by measuring the position. Of course, $P_Z$ can be calculated in other ways as well as indicated by block 676.

Operation 600 proceeds at block 680 where machine 100 is controlled based on the position of one or more sensor(s) 222.

Figure 7A:
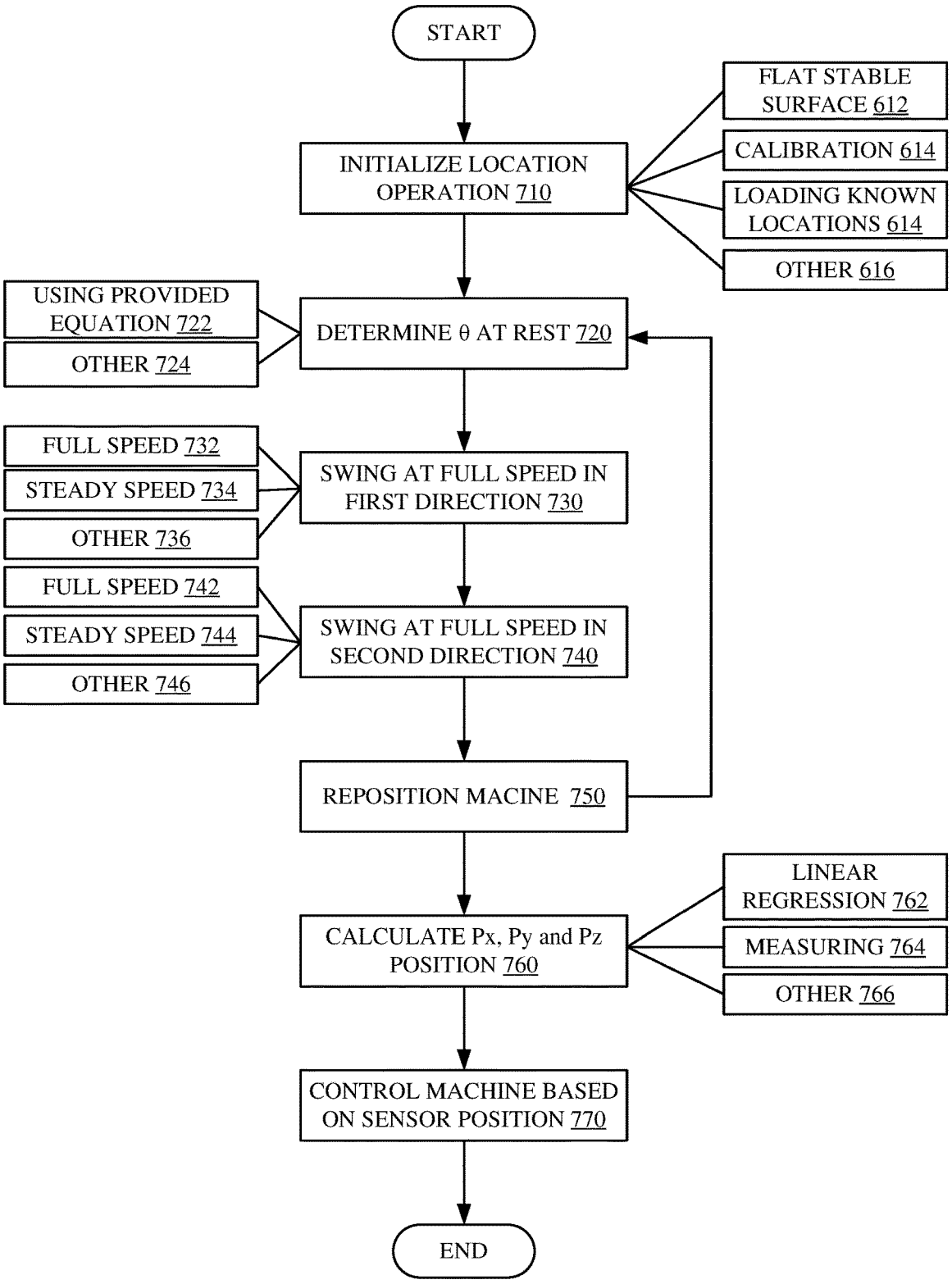
FIG. 7A is a flow diagram showing an example method of determining an arm sensor location.
Figure 7B:
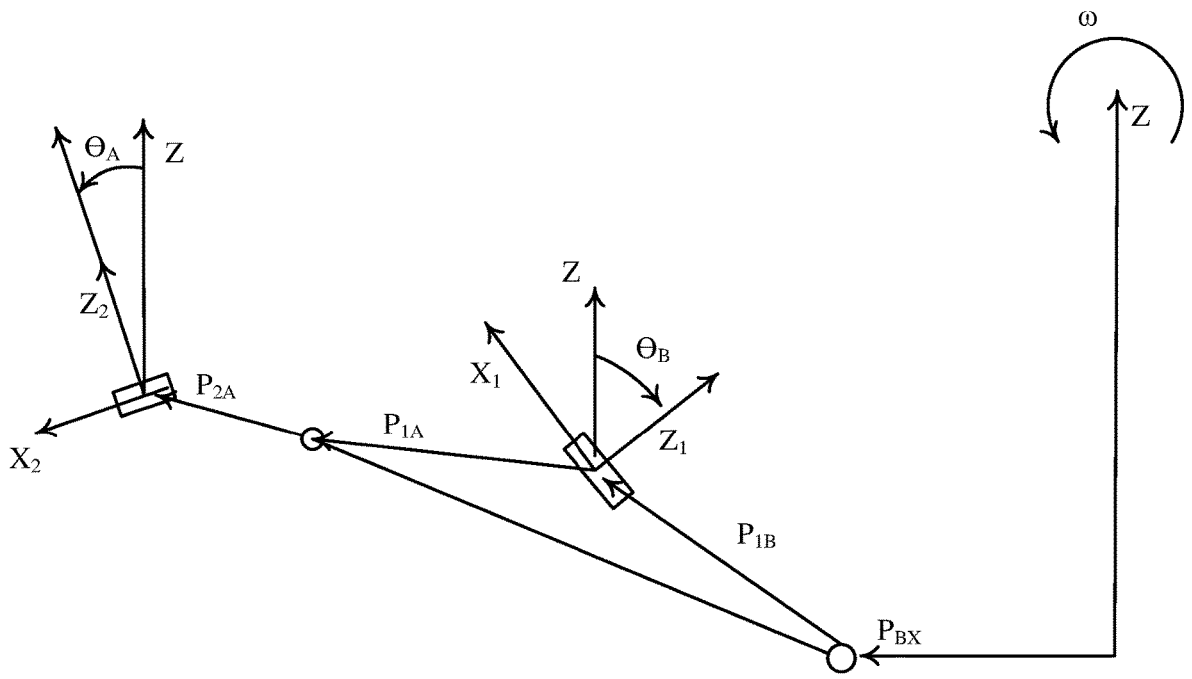
FIG. 7B is a diagrammatic view showing an example mobile machine.

FIG. 7A is a flow diagram showing an example operation of determining an arm sensor position. Operation 700 begins at block 710 with initialization. As indicated by block 712, initialization can include moving machine 100 to a flat stable surface. As indicated by block 714, initialization can include calibrating sensors 220 on machine 100. As indicated by block 716, initialization can include loading past calculated positions. For example, positions of the rotatable house sensor, boom 110, and linkage pins. Of course, initialization can include a variety of other things as indicated by block 718.

Operation 700 proceeds at block 720 where θ is determined at rest. Theta can be determined using equation 1 above, as indicated by block 722. Of course, theta can be determined in other ways as well as indicated by bloc 724.

Operation 700 proceeds at block 730 where rotatable house 102 is swung about a Z axis in one direction (e.g., counter clockwise) and during this rotation, sensor data is gathered. For example, sensors 220 (e.g., IMU 222) sense characteristics of the motion and the sensed data is stored. As indicated by block 732, rotatable house 102 is swung at full speed. As indicated by block 734, in addition or in the alternative, rotatable house 102 is swung at a steady state that could be less than full speed. As indicated block 736, in addition or in the alternative, rotatable house 102 is swung at a different speed or state.

Operation 700 proceeds at block 740 where rotatable house 102 is swung about the Z axis in a second direction that is opposite the first direction (e.g., clockwise) and during this rotation, sensor data is gathered. For example, (e.g., IMU 222) sense characteristics of the motion and the sensed data is stored. As indicated by block 742, rotatable house is swung at full speed. As indicated by block 744, in addition or in the alternative, rotatable house 102 is swung at a steady state that could be less than full speed. As indicated by block 746, in addition or in the alternative, rotatable house 102 is swung at a different speed or state.

Operation 700 proceeds at block 750 where machine 100 is repositioned. Pose sequence logic 231 can determine the pose at which machine 100 should be repositioned to. For example, machine 100 can reposition into four different poses for four iterations, a first pose has a tucked arm 116 and a lowered boom 110, a second pose has a tucked arm 116 and a raised boom 110, a third pose has an extended arm 116 and a raised boom 110 and a fourth pose has an extended arm 116 and a lowered boom 110.

Operation 700 proceeds at block 760 where $P_X$, $P_Y$, and $P_Z$ are determined. As indicated by block 762, $P_X$, $P_Y$, and $P_Z$ can be determined using a linear regression of the values gathered in block 730 and 740. As indicated by block 764, $P_X$, $P_Y$, and $P_Z$ can be determined by measuring the location of the sensor. $P_X$, $P_Y$, and $P_Z$ can be determined in other ways as well, as indicated by block 766.

Operation 700 proceeds at block 770 where machine 100 is controlled based on the position of one or more sensor(s) 222.

Figure 8:
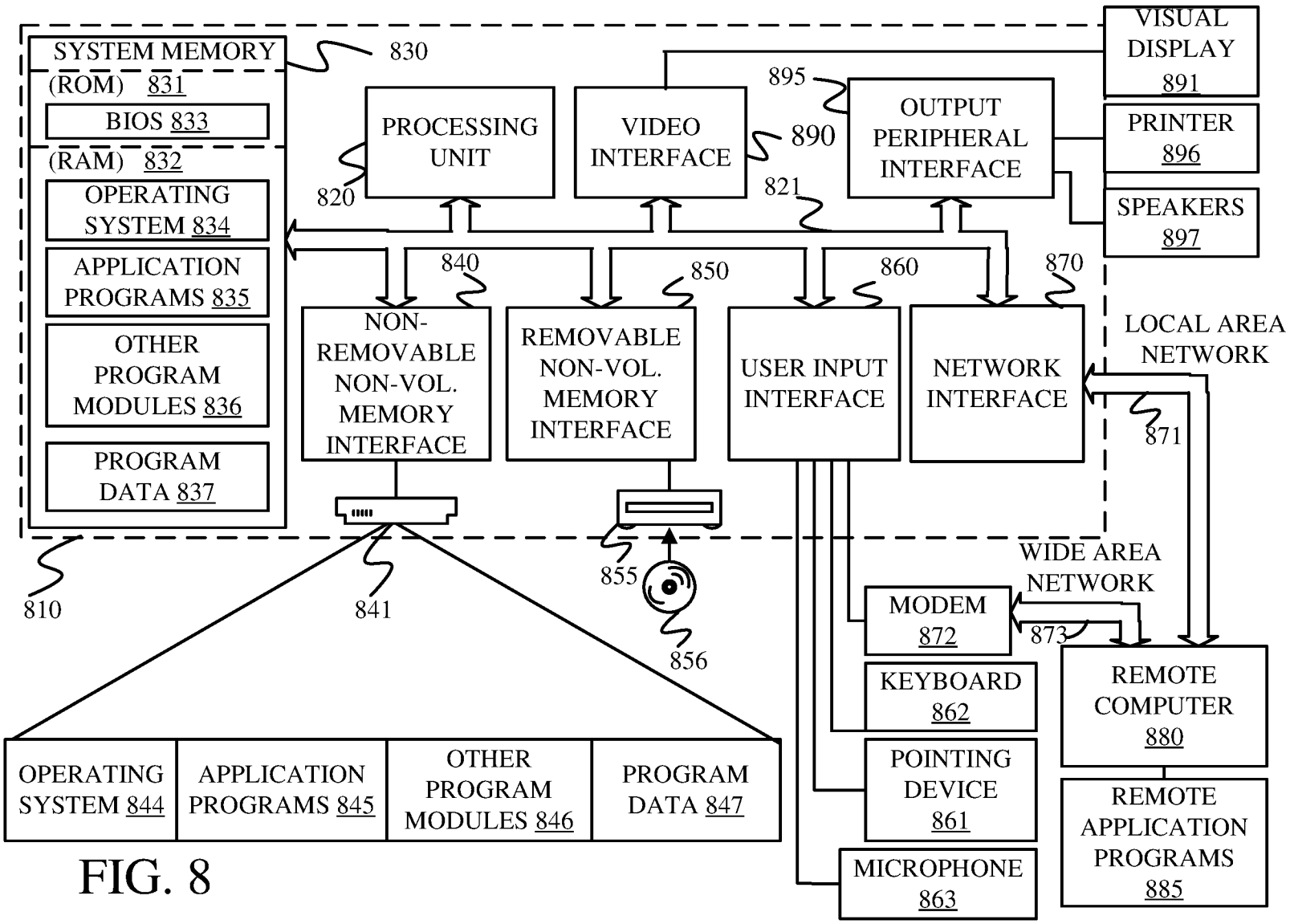
FIG. 8 is a block diagram showing an example computing system.

FIG. 8 is one embodiment of a computing environment in which elements of FIG. 2, or parts of it, (for example) can be deployed. With reference to FIG. 8, an exemplary system for implementing some embodiments includes a general-purpose computing device in the form of a computer 810. Components of computer 810 may include, but are not limited to, a processing unit 820 (which can comprise controller 202), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 2 can be deployed in corresponding portions of FIG. 8.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random-access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable volatile/nonvolatile computer storage media. By way of example only, FIG. 8 illustrates a hard disk drive 841 that reads from or writes to non-removable, nonvolatile magnetic media, a magnetic disk drive 851, nonvolatile magnetic disk 852, an optical disk drive 855, and nonvolatile optical disk 856. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (e.g., ASICs), Program-specific Standard Products (e.g., ASSPs), System-on-a-chip systems (SOCs), Complex Programmable Logic Devices (CPLDs), etc.

The drives and their associated computer storage media discussed above and illustrated in FIG. 8, provide storage of computer readable instructions, data structures, program modules and other data for the computer 810. In FIG. 8, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 10 illustrates, for example, that remote application programs 885 can reside on remote computer 880.

It should also be noted that the different embodiments described herein can be combined in different ways. That is, parts of one or more embodiments can be combined with parts of one or more other embodiments. All of this is contemplated herein. The flow diagrams are shown in a given order it is contemplated that the steps may be done in a different order than shown.

Example 1 is a mobile machine comprising:

a rotatable house;

a sensor operably coupled to the rotatable house and configured to provide at least one sensor signal indicative of acceleration of the sensor; and one or more controllers coupled to the sensor, the one or more controllers being configured to implement:

sensor position determination logic that determines a sensor position of the sensor on the rotatable house based on the sensor signal during a rotation of the rotatable house; and control signal generator logic that generates a control signal to control the mobile machine, based on the sensor position.

Example 2 is the mobile machine of claim 1, wherein the one or more controllers are configured to implement:

motion sequence logic that causes the rotation of the rotatable house to comprise a sequence of rotations and rest states.

Example 3 is the mobile machine of any or all previous examples, wherein the sensor position determination logic determines the sensor position based on a best fit algorithm applied on:

the at least one sensor signal during a rest state; and the at least one sensor signal during one of the rotations.

Example 4 is the mobile machine of any or all previous examples, further comprising a boom coupled to the rotatable house and a boom sensor coupled to the boom, the boom sensor generates a boom sensor signal indicative of the acceleration of the boom sensor; and wherein the sensor position determination logic comprises boom sensor position determination logic that determines a boom sensor position based on the boom sensor signal during the rotation of the rotatable house.

Example 5 is the mobile machine of any or all previous examples, wherein the linkage sensor position determination logic receives machine geometry data from a datastore and wherein the linkage sensor position determination logic determines the sensor position based on the machine geometry data.

Example 6 is the mobile machine of any or all previous examples, wherein the one or more controllers are configured to implement:

pose sequence logic that causes the boom to actuate to one or more poses during the sequence of rotations and rest states.

Example 7 is the mobile machine of any or all previous examples, wherein the one or more poses comprise:

a first pose where the boom is at a first angle;

a second pose where the boom is at a second angle.

Example 8 is the mobile machine of any or all previous examples, wherein the second angle is approximately 90 degrees offset from the first angle.

Example 9 is the mobile machine of any or all previous examples, further comprising an arm coupled to the boom and an arm sensor coupled to the arm, the arm sensor generates an arm sensor signal indicative of the acceleration of the arm sensor; and wherein the sensor position determination logic comprises arm sensor position determination logic that determines an arm sensor position based on the arm sensor signal during the rotation of the rotatable house.

Example 10 is the mobile machine of any or all previous examples 1, wherein sensor position determination logic generates an interface that allows a user to enter user input and sensor position determination logic determines the sensor position based on the user input.

Example 11 is the mobile machine of any or all previous examples, wherein the sensor comprises an IMU.

Example 12 is a method of controlling an excavator, the method comprising:

obtaining, periodically, sensor signals from a sensor operably coupled to the excavator;

actuating one or more controllable subsystems of the excavator through a series of motions;

determining a sensor location of the sensor based on the sensor signals obtained during the series of motions;

controlling the excavator based on the sensor location.

Example 13 is the method of any or all previous examples, wherein actuating the one or more controllable subsystems of the excavator through the series of motions comprises:

actuating the one or more controllable subsystems to a first pose;

holding the one or more controllable subsystems at rest in the first pose; and rotating the excavator while maintaining the first pose.

Example 14 is the method of any or all previous examples, wherein actuating the one or more controllable subsystems of the excavator through the series of motions comprises:

rotating the excavator in a second direction while maintaining the first pose.

Example 15 is the method of any or all previous examples, wherein actuating the one or more controllable subsystems of the excavator through the series of motions comprises:

actuating the one or more controllable subsystems to a second pose;

holding the one or more controllable subsystems at rest in the second pose; and rotating the excavator while maintaining the second pose.

Example 16 is the method of any or all previous examples, wherein determining the sensor location comprises:

determining a best fit of the sensor data based on the sensor signals obtained during the series of motions.

Example 17 is the method of any or all previous examples, wherein actuating the one or more controllable subsystems of the excavator through the series of motions comprises:

actuating the one or more controllable subsystems to a third pose;

holding the one or more controllable subsystems at rest in the third pose; and rotating the excavator while maintaining the third pose.

Example 18 is a mobile machine comprising:

a rotatable house;

a boom;

a first IMU sensor coupled to the rotatable house;

a second IMU sensor that couples to the boom;

house sensor position determination logic that determines a position of the first IMU sensor;

boom sensor position determination logic that determines a position of the second IMU sensor;

a control system that controls the mobile machine based on the position of the first IMU sensor and the position of the second IMU sensor.

Example 19 is the mobile machine of any or all previous examples, wherein the house sensor position determination logic determines the position of the first IMU sensor based on a first sensor signal generated by the first IMU sensor; and wherein the boom sensor position determination logic determines the position of the second IMU sensor based on a second sensor signal generated by the second IMU sensor.

Example 20 is the mobile machine of any or all previous examples, further comprising:

an arm;

a third IMU sensor coupled to the arm;

arm sensor position determination logic that determines a position of the third IMU sensor based on a third sensor signal generated by the third IMU sensor.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile machine comprising:

a rotatable house;

a sensor operably coupled to the rotatable house and configured to provide at least one sensor signal indicative of acceleration of the sensor; and one or more controllers coupled to the sensor, the one or more controllers being configured to implement:

motion sequence logic that causes a sequence of rotations and rest states of the rotatable house;

sensor position determination logic that determines a sensor position of the sensor on the rotatable house based on a best fit algorithm applied on the at least one sensor signal during a rest state and the at least one sensor signal during one of the rotations; and control signal generator logic that generates a control signal to control the mobile machine, based on the sensor position.

2. The mobile machine of claim 1, further comprising:

a boom coupled to the rotatable house and a boom sensor coupled to the boom, the boom sensor generates a boom sensor signal indicative of the acceleration of the boom sensor; and wherein the sensor position determination logic comprises boom sensor position determination logic that determines a boom sensor position based on the boom sensor signal during the rotation of the rotatable house.

3. The mobile machine of claim 2, wherein the boom sensor position determination logic receives machine geometry data from a datastore and wherein the boom sensor position determination logic determines the sensor position based on the machine geometry data.

4. The mobile machine of claim 2, wherein the one or more controllers are configured to implement:

pose sequence logic that causes the boom to actuate to one or more poses during the sequence of rotations and rest states.

5. The mobile machine of claim 4, wherein the one or more poses comprise:

a first pose where the boom is at a first angle;

a second pose where the boom is at a second angle.

6. The mobile machine of claim 5, wherein the second angle is approximately 90 degrees offset from the first angle.

7. The mobile machine of claim 2, further comprising:

an arm coupled to the boom and an arm sensor coupled to the arm, the arm sensor generates an arm sensor signal indicative of the acceleration of the arm sensor; and wherein the sensor position determination logic comprises arm sensor position determination logic that determines an arm sensor position based on the arm sensor signal during the rotation of the rotatable house.

8. The mobile machine of claim 1, wherein sensor position determination logic is configured to generate an interface that allows a user to enter user input and wherein the sensor position determination logic is configured to determine the sensor position based on the user input.

9. The mobile machine of claim 1, wherein the sensor comprises an IMU.

10. A method of controlling an excavator, the method comprising:

actuating one or more controllable subsystems of the excavator through a series of motions, wherein actuating the one or more controllable subsystems of the excavator through the series of motions comprises:

actuating the one or more controllable subsystems to a first pose;

holding the one or more controllable subsystems at rest in the first pose;

rotating the excavator while maintaining the first pose;

actuating the one or more controllable subsystem to a second pose;

holding the one or more controllable subsystems at rest in the second pose; and rotating the excavator while maintaining the second pose; and obtaining sensor signals, from a sensor coupled to the excavator, during the series of motions;

determining a best fit of data indicated by the sensor signals obtained during the series of motions;

determining a sensor location of the sensor based on the determined best fit; and controlling the excavator based on the sensor location.

11. The method of claim 10, wherein rotating the excavator while maintaining the first pose comprises:

rotating the excavator in a first direction while maintaining the first pose.

12. The method of claim 11, wherein rotating the excavator while maintaining the first pose further comprises:

rotating the excavator in a second direction while maintaining the first pose.

13. The method of claim 10, wherein rotating the excavator while maintaining the second pose comprises:

rotating the excavator in a first direction while maintaining second pose.

14. The method of claim 13, wherein rotating the excavator while maintaining the second pose further comprises:

rotating the excavator in a second direction while maintaining the second pose.

15. The method of claim 10, wherein actuating the one or more controllable subsystems of the excavator through the series of motions further comprises:

actuating the one or more controllable subsystems to a third pose;

holding the one or more controllable subsystems at rest in the third pose; and rotating the excavator while maintaining the third pose.

16. The method of claim 15, wherein rotating the excavator while maintaining the third pose comprises:

rotating the excavator in a first direction while maintaining the third pose; and rotating the excavator in a second direction while maintaining the third pose.

17. The method of claim 10, wherein rotating the excavator while maintaining the first pose comprises:

rotating the excavator in one of a clockwise direction or a counterclockwise direction while maintaining the first pose; and rotating the excavator in the other of the clockwise direction or the counterclockwise direction while maintaining the first pose; and wherein rotating the excavator while maintaining the second pose comprises:

rotating the excavator in one of the clockwise direction or the counterclockwise direction while maintaining the first pose; and rotating the excavator in the other of the clockwise direction or the counterclockwise direction while maintain the second pose.

18. A mobile machine comprising:

a rotatable house;

a boom;

sequence logic that causes a series of motions of the mobile machine;

a first IMU sensor coupled to the rotatable house and that generates sensor data during the series of motions;

a second IMU sensor that couples to the boom and that generates sensor data during the series of motions;

house sensor position determination logic that determines a position of the first IMU sensor based on a best fit of the sensor data generated by the first IMU sensor during the series of motions;

boom sensor position determination logic that determines a position of the second IMU sensor based on a best fit of the sensor data generated by the second IMU sensor during the series of motions; and a control system that controls the mobile machine based on the position of the first IMU sensor and the position of the second IMU sensor.

19. The mobile machine of claim 18, wherein the series of motions includes rotation in a first direction and rotation in a second direction.

20. The mobile machine of claim 18, further comprising:

an arm;

a third IMU sensor coupled to the arm and that generates sensor data during the series of motions; and arm sensor position determination logic that determines a position of the third IMU sensor based on a best fit of the sensor data generated by the third IMU sensor during the series of motions.

* * * * *